US012798841B2

(12) United States Patent
Han et al.

(10) Patent No.: US 12,798,841 B2
(45) Date of Patent: Nov. 17, 2026

(54) LID WITH A MOVABLY OPENABLE WATER DRINKING COMPONENT

(71) Applicant: Yiwu Mitu Brand Management Co., LTD, Jinhua City (CN)

(72) Inventors: Xiong Han, Yiwu City (CN); Jiye Sun, Yiwu City (CN)

( * ) Notice: Subject to any disclaimer, the term of this patent is extended or adjusted under 35 U.S.C. 154(b) by 0 days.

(21) Appl. No.: 19/042,462

(22) Filed: Jan. 31, 2025

(65) Prior Publication Data

US 2026/0138795 A1 May 21, 2026

(30) Foreign Application Priority Data

Nov. 20, 2024 (CN) ..... 202411662324.1

(51) Int. Cl.
*B65D 47/30* (2006.01)
*A47G 19/22* (2006.01)
*B65D 47/32* (2006.01)

(52) U.S. Cl.
CPC ..... *B65D 47/305* (2013.01); *A47G 19/2272* (2013.01); *B65D 47/32* (2013.01)

(58) Field of Classification Search
CPC ... B65D 47/305; B65D 47/32; A47G 19/2272
USPC ..... 220/254.8, 709
See application file for complete search history.

(56) References Cited

U.S. PATENT DOCUMENTS 5,150,815 A * 9/1992 Saklad ..... B65D 77/283 215/229
5,361,934 A * 11/1994 Spence, Jr. ..... B65D 47/2043 220/709
2007/0045217 A1* 3/2007 Cho ..... B65D 51/285 220/709
2013/0126527 A1* 5/2013 Chiu ..... A47G 21/18 220/709
2019/0144173 A1* 5/2019 Fu ..... B65D 43/0225 222/1
2025/0248549 A1* 8/2025 Cudworth ..... A47G 19/2272

* cited by examiner

*Primary Examiner* — James N Smalley
(74) *Attorney, Agent, or Firm* — Sandy Lipkin

(57) ABSTRACT

The invention discloses a lid with a movably openable water drinking component, which comprises a cover and a drinking component on the cover, cover, and a driving element is arranged in the cavity, and a water drinking downward by the driving component, and the opening or closing of the water drinking component is controlled by manually rotating the driving element, drinking component, and increases the volume of the containers.

9 Claims, 10 Drawing Sheets

LID WITH A MOVABLY OPENABLE WATER DRINKING COMPONENT

CROSS REFERENCE TO RELATED APPLICATIONS

The present application claims the priority of Chinese patent application No. 202411662324.1, filed on Nov. 20, 2024, and contents of which are incorporated herein by reference.

TECHNICAL FIELD

The present invention relates to the technical field of lids, in particular to a lid with a movably openable water drinking component on it.

BACKGROUND ART

Lid, a common commodity, is usually used with cups to prevent the liquid inside from spilling out. Usually, a lid is provided with a direct drinking spout, through which liquid flows out when the cup is turned over. In order to meet people's different needs, cups with a drinking straw on the lid have been invented, and liquid in the cup can be absorbed out with the straw.

For cups with a drinking straw, it is required to open the top cover before drinking with the straw, and to open the top cover, either flip open or remove it. If the cover is flip opened to one side, users are prone to touch it when drinking with the straw, and if it is removed, it has the risk of loss, both of which brings users a bad drinking experience.

SUMMARY OF THE INVENTION

In order to overcome the deficiencies in the prior art, this invention provides a lid with a movably openable water drinking component. In order to solve the above technical problems, the present invention adopts the following technical schemes.

A lid with a movably openable water drinking component comprises a cover and a drinking element on the cover, wherein an air return valve is arranged on the cover, and is characterized in that a cavity for the water drinking component to move is arranged on the cover, and a driving element is arranged in the cavity, and the water drinking component is installed in the driving element, so that the water drinking component is driven to move by the driving element;

The water drinking component provides an open mode and a close mode;

In the open mode, move the driving element to drive the water drinking component upwards till it protrudes above the cover;

In the close mode, move the driving element to drive the water drinking component downwards to conceal in the cavity.

Further, the driving element comprises a rotating cover and a driving casing, wherein the cover is provided with a mounting groove for the rotating cover, so that the rotating cover is rotatably installed in the mounting groove;

The driving casing is rotatably installed in the cavity, and a clamping part is arranged between the rotating cover and the driving casing, so that the rotating cover drives the driving casing to rotate synchronously;

The water drinking component is installed in the driving casing, a through hole is set on the rotating cover for the water drinking component to pass, and a movable part is arranged between the cavity and the water drinking element; the driving element rotates to drive the water drinking component to ascend and descend through the movable part.

Further, the movable part comprises a movable groove which is arranged on the inner wall of the cavity and extends upward in an arc shape, a guide groove on the side wall of the driving casing, and a movable block which passes through the guide groove at both sides of the water drinking component, and the movable block is buckled into the movable groove, and when the driving element rotates, the movable block moves along the track of the movable groove, which drives the movement of the water drinking component.

Further, the water drinking component comprises a diversion pipe and a movable suction nozzle sleeved on the diversion pipe, wherein the inner wall at the bottom of the suction nozzle is provided with a concave sealing groove, and a sealing ring is arranged in the sealing groove; The lower end of the diversion pipe is provided with a limiting step, which is placed at the bottom of the cavity, and the driving casing is arranged on the limiting step.

Further, an assembly groove extends downwards from the bottom of the cavity, the tail end of the diversion pipe penetrates through the driving casing and the cavity and is buckled into the assembly groove, the bottom of the diversion pipe is provided with a sealing element, which passes through the opening on the bottom of the assembly groove and is clamped at the opening to form a seal.

Further, the sealing element is provided with a rib ring clamped at the opening, and the rib ring is provided with a guide surface.

Further, one side of the assembly groove is provided with an openable first water inlet, and the side wall of the diversion pipe is provided with a second water inlet. When the water drinking component rotates, the suction nozzle rises and protrudes above the rotating cover, and the diversion pipe rotates until the second water inlet is aligned with the first water inlet.

Further, a sealing ring is arranged between the assembly groove and the diversion pipe, and is sleeved on the diversion pipe, a notch corresponding to the second water inlet is set on the sealing ring, and the sealing ring rotates synchronously with the diversion pipe; The sealing ring is provided with a first sealing rib and a second sealing rib, which are located at the upper and lower ends of the first water inlet respectively.

Further, a hollow connecting column is arranged on the outer side of the assembly groove at the bottom of the cavity, and a detachable suction pipe adapter is installed on the connecting column, with a toggle piece arranged on the side wall of the suction pipe adapter.

Further, the rotating cover is provided with a sliding cover with a movably openable water drinking component, a sliding cover mounting groove is arranged on the rotating cover, and the sliding cover is movably installed in the mounting groove; the sliding cover is provided with a sliding block on the two sides, and the side wall of the sliding cover mounting groove is provided with a sliding groove adapted for the sliding block to slide in the groove; The sliding cover has a first pushing part and a second pushing part on its two ends.

Compared with the prior art, the invention has the beneficial effects that:

The water drinking component of the present invention provides an open mode and a close mode: in the open mode, manually rotate the driving element, which drives the water drinking component to move upwards till it protrudes above the cover; In the close mode, manually rotate the driving element to drive the water drinking component to move downwards and conceal in the cavity. According to the invention, the opening or closing of the water drinking component is controlled by manually rotating the driving element; when drinking, the water drinking component rises above the cover, and after drinking, it falls into the cavity, which enables a convenient operation, saves a top cover to seal the water drinking component, and increases the volume of the containers.

Compared with traditional flip covers, the water drinking component can be opened to different degrees, so users will not touch the cover when drinking. Compared with traditional threaded covers, the water drinking component does not need to be removed, which avoids any loss and ensures users a good drinking experience.

DESCRIPTION OF ACCOMPANIED FIGURES

Figure 1:
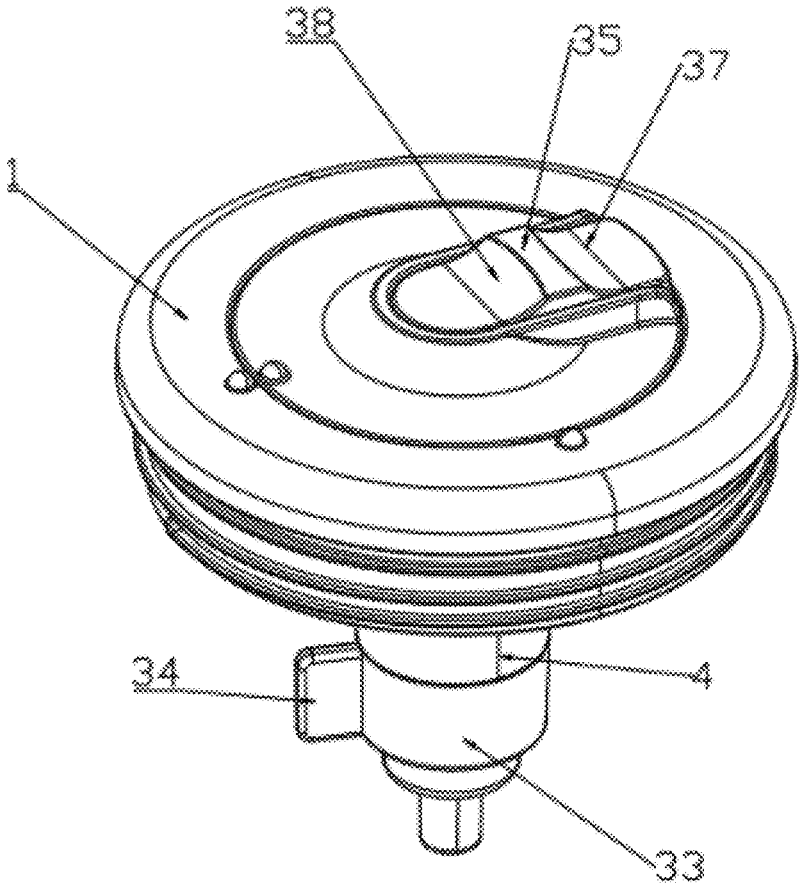
FIG. 1 is a perspective view of the present invention.

The corresponding reference numeral parts in the accompanied figures are: 1. Cover; 2. Water drinking component; 3. Air return member; 4. Cavity; 5. Driving element; 6. Rotating cover; 7. Driving casing; 8. Rotating cover mounting groove; 9. Through hole; 10. Movable part; 11. Movable groove; 12. Guide groove; 13. Movable block; 14. Diversion pipe; 15. Suction nozzle; 16. Sealing groove; 17. Sealing ring; 18. Limiting step; 19. Notch; 20. Fixture block; 21. Assembly groove; 22. Sealing element; 23. Opening; 24. Rib ring; 25. Guide surface; 26. First water inlet; 27. Second water inlet; 28. Sealing ring; 29. Hole; 30. First sealing rib; 31. Second sealing rib; 32. Connecting column; 33. Suction pipe adapter; 34. Toggle piece; 35. Sliding cover; 36. Sliding cover mounting groove; 37. First pushing part; 38. Second pushing part; 39. Upper magnetic part; 40. Lower magnetic part a; 41. Lower magnetic part b; 42. Incision.

The technical scheme in the embodiments of the present invention will be described in further detail below in conjunction with the accompanied figures. The above are only the preferred embodiments of the present invention. Based on the embodiments in the present invention, all other embodiments obtained by those of ordinary skill in the art without any creative effort should be regarded as the protection scope of the present invention.

Figure 2:
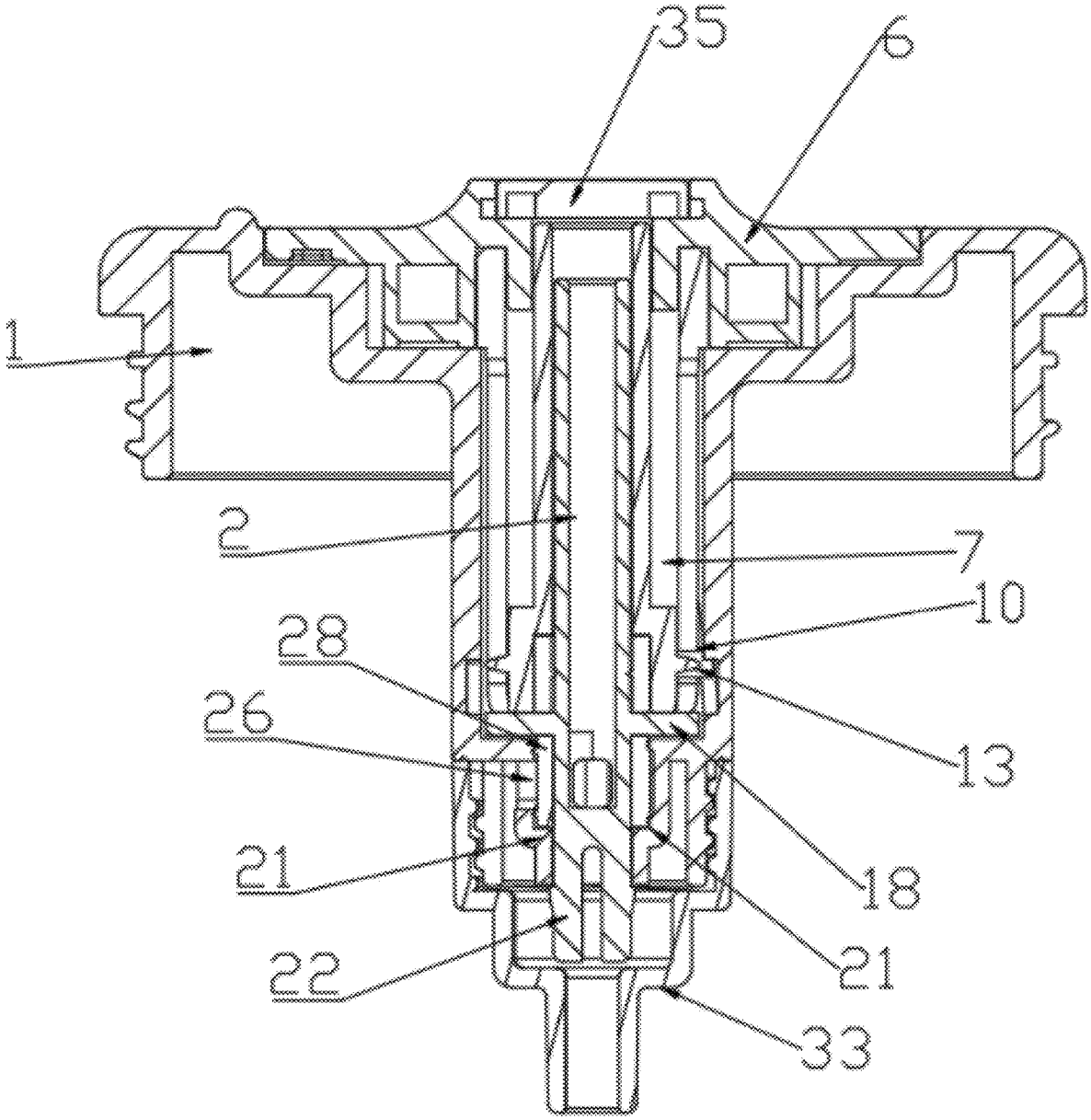
FIG. 2 is a sectional view (1) of the present invention.
Figure 3:
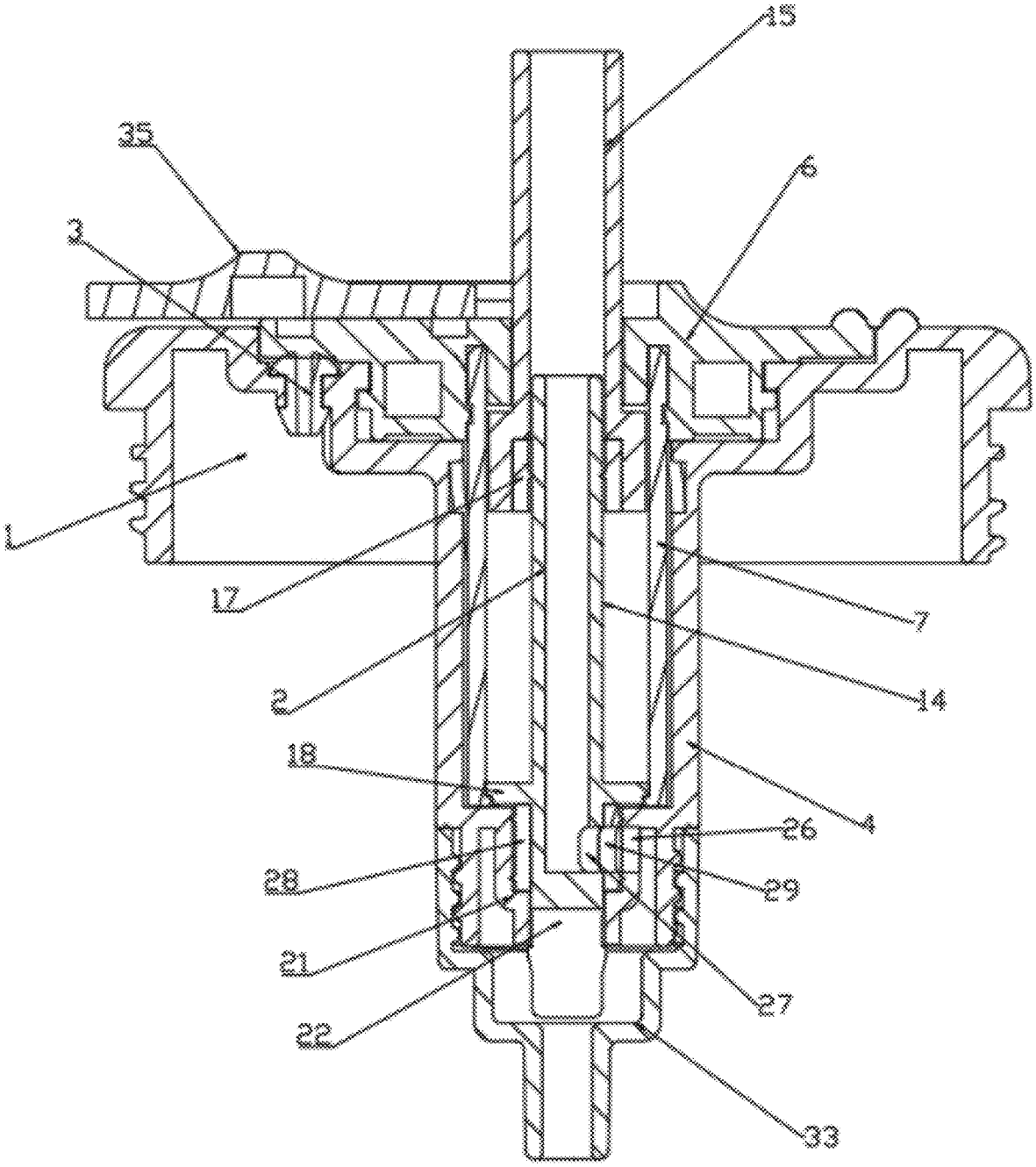
FIG. 3 is a sectional view (2) of the present invention.
Figure 4:
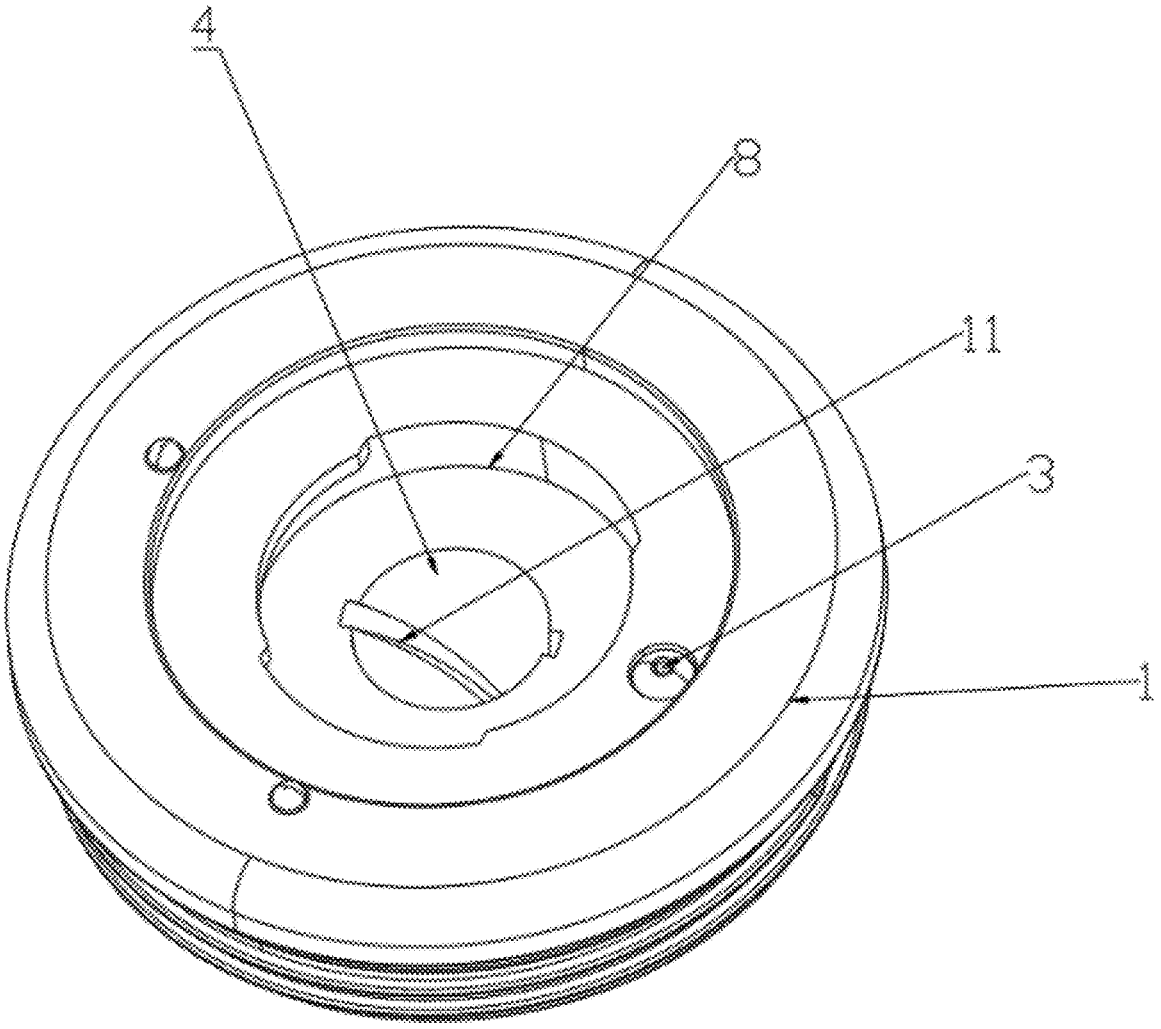
FIG. 4 is a perspective view of the lid (1) of the present invention.
Figure 5:
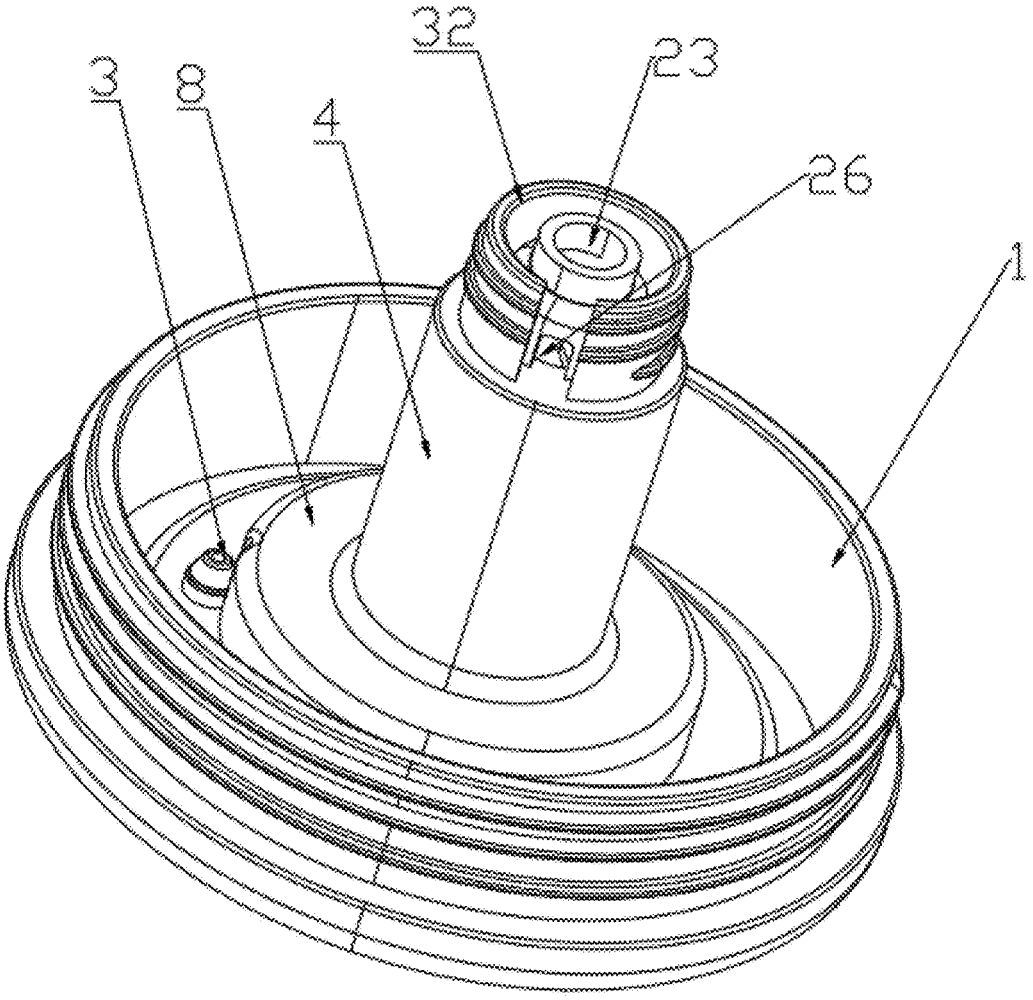
FIG. 5 is a perspective view of the lid (2) of the present invention.
Figure 6:
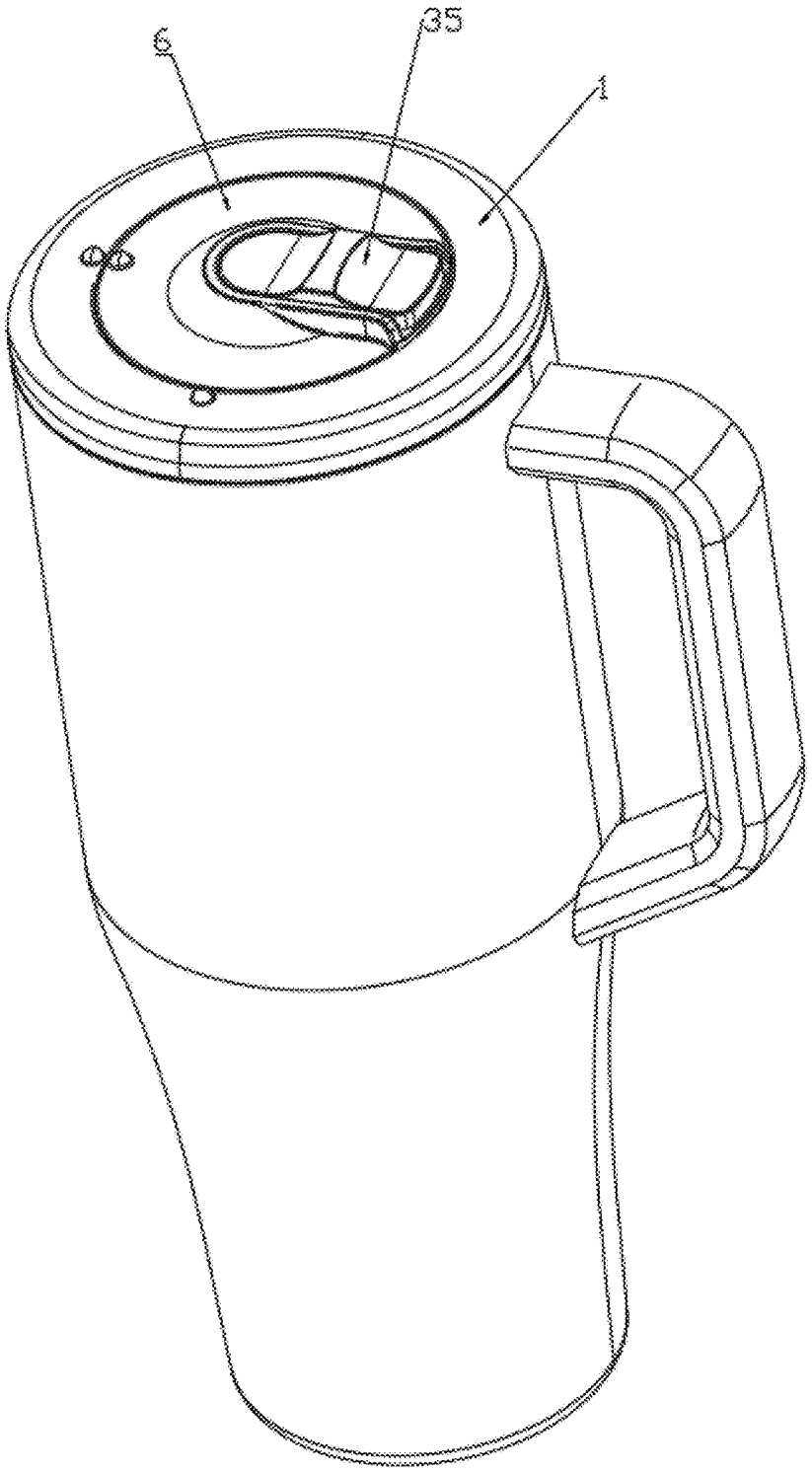
FIG. 6 is a usage state diagram of the present invention.
Figure 7:
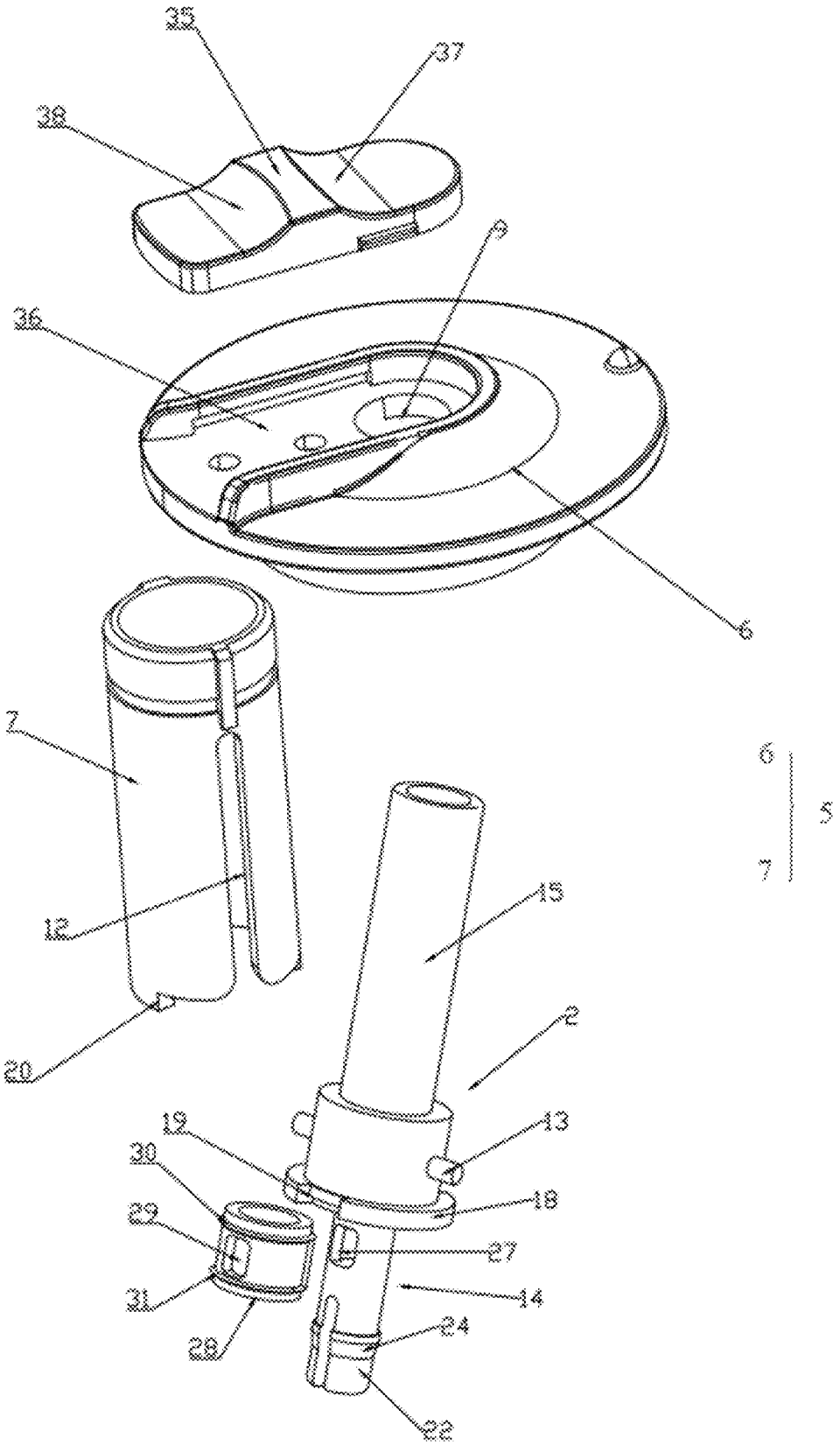
FIG. 7 is an exploded view of the present invention.
Figure 8:
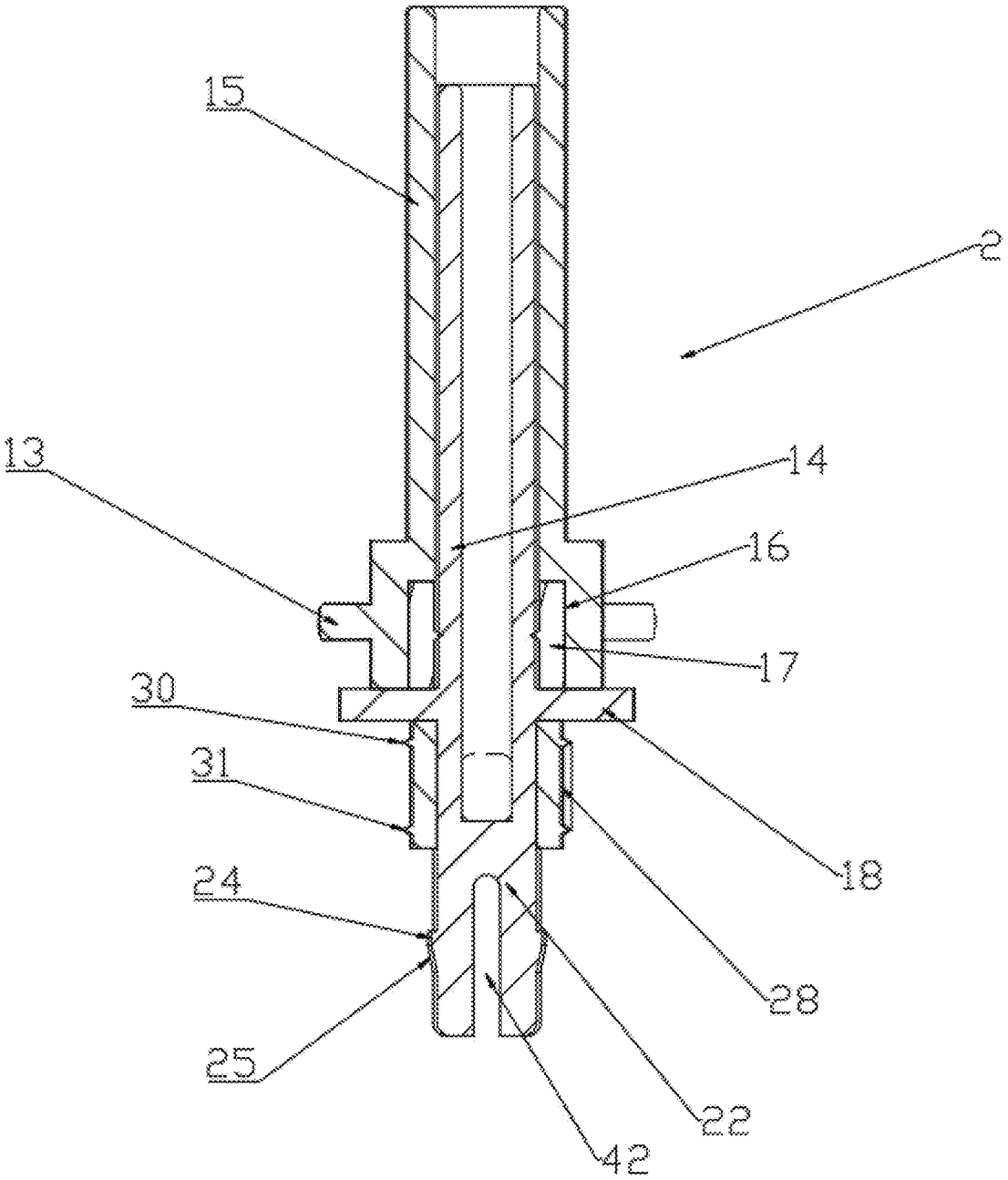
FIG. 8 is a sectional view of the water drinking component of the present invention.
Figure 9:
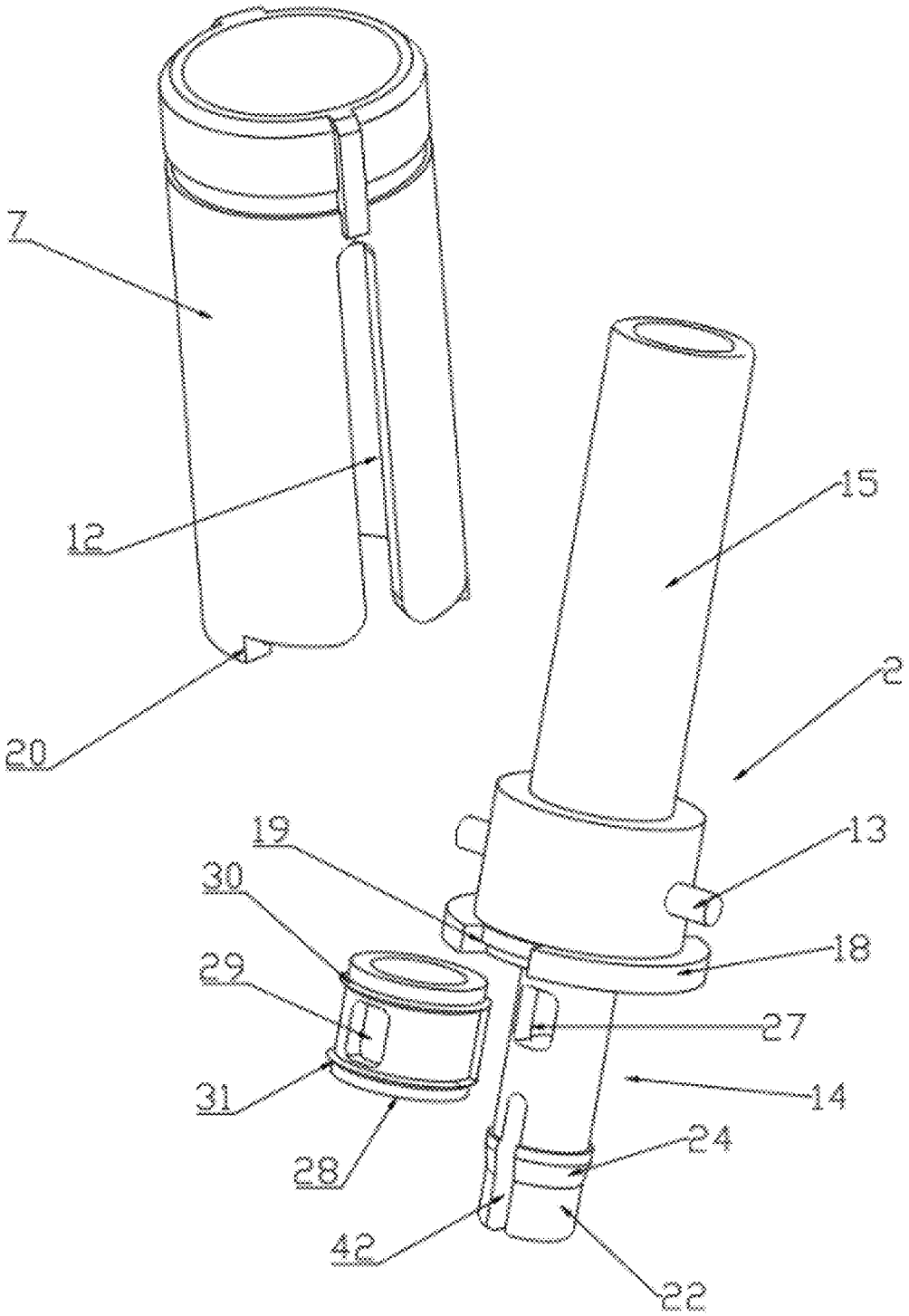
FIG. 9 is an exploded view of the water drinking component of the present invention.
Figure 10:
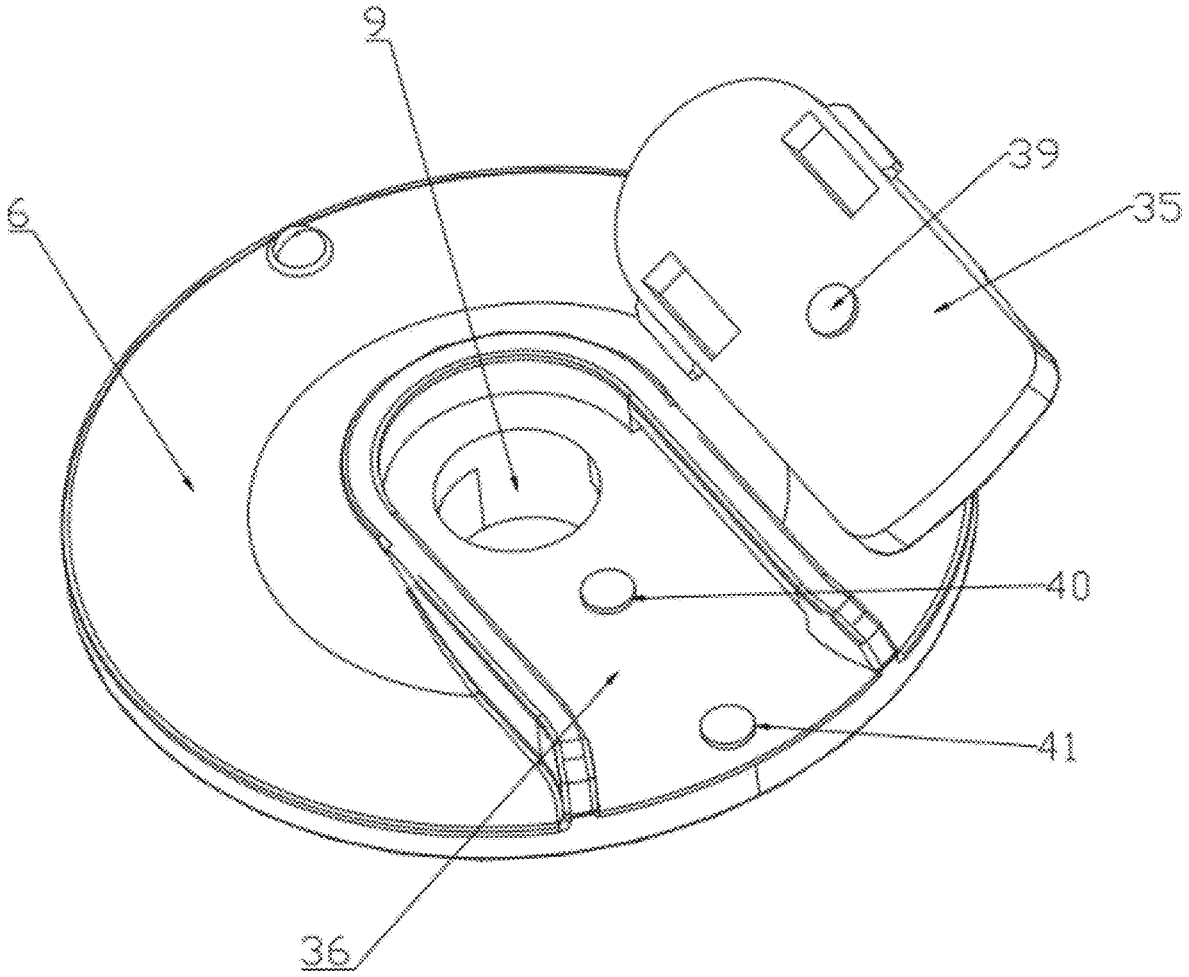
FIG. 10 is an exploded view of the rotating cover and the sliding cover.

As shown in FIG. 1-10, a lid with a movably openable water drinking component comprises a cover 1 and a water drinking component 2 on the cover 1, wherein an air return member 3 is arranged on the cover 1, and the cover 1 is used in cooperation with a container to drink the liquid in the container through the water drinking component 2. In order to overcome the negative pressure generated during continuous drinking, air will enter the container through the air return member 3 to balance the pressure difference inside and outside the container. A cavity 4 for the water drinking component 3 to move is arranged on the cover 1, and a driving element 5 is arranged in the cavity, and the water drinking component 3 is installed in the driving element 5, so that the water drinking component is driven to move upwards and downwards by the driving element 5.

The water drinking component provides an open mode and a close mode: in the open mode, manually rotate the driving element 5, which drives the water drinking element 2 to move upwards till it protrudes above the cover 1, so as to drink the liquid in the container; In the close mode, manually rotate the driving element 5 to drive the water drinking component 2 to move downwards and conceal in the cavity 4. According to the invention, the opening or closing of the water drinking component 2 is controlled by manually rotating the driving element 5; when drinking, the water drinking element 2 rises above the cover 1, and after drinking, it falls into the cavity 4, which enables a convenient operation, saves a top cover to seal the water drinking component 2, and increases the volume of the containers.

The traditional top covers represent two ways: flip covers and threaded covers. Compared with traditional flip covers, the water drinking component 2 can be opened to different degrees, so users will not touch the cover when drinking. Compared with traditional threaded covers, the water drinking component does not need to be removed, which saves the risk of loss.

The driving component 4 comprises a rotating cover 6 and a driving Casing 7, Wherein the Cover 1 is Provided With a Mounting Groove 8 for the rotating cover, so that the rotating cover is rotatably installed in the mounting groove 8; after assembly, the rotating cover 6 is aligned with cover 1. The driving casing 7 is rotatably installed in the cavity, and a clamping part is arranged between the rotating cover 6 and the driving casing 7, so that the rotating cover 6 drives the driving casing 7 to rotate synchronously. The clamping of the driving casing 7 and the rotating cover is realized by buckling of the clamping block and the clamping groove. The water drinking component 2 is installed in the driving casing, and a through hole 9 is set on the rotating cover 6 for the water drinking component 2 to pass. When the water drinking component 2 is opened, it moves upward through the through hole 9 and protrudes above the rotating cover 6. A movable part 10 is arranged between the cavity 4 and the water drinking component 2. The driving element 5 rotates, drives the water drinking component 2 to ascend and descend by the movable part 10. Rotate the driving element 5 clockwise, the water drinking component 2 ascends, and rotate it counterclockwise, the water drinking component 2 descends.

The movable part 10 comprises a movable groove 11 which is arranged on the inner wall of the cavity 4 and extends upward in an arc shape, a guide groove 12 on the side wall of the driving casing 7, and the movable block 13 which passes through the guide groove 12 at both sides of the water drinking component 2. The movable block 13 is adapted to and buckled into the movable groove 11. When the driving element 7 rotates, the movable block 13 is forced to rotate to one side through the guide groove 12, moves along the arc-shaped upward track of the movable groove 11, so that the water drinking component 2 is lifted. The width of the guide groove 12 is same as that of the movable block 13, so that the movable block 13 is always in the guide groove 12 during rotation, or moving up or down in the guide groove 12 when the water drinking component 2 ascends or descends.

The water drinking component 2 comprises a diversion pipe 14 and a suction nozzle 15 which is sleeved on the diversion pipe 14 and can move up and down. The diversion pipe 14 is always in the driving casing 7, moving up and down by the up-and-down displacement of the suction nozzle 15. The inner wall of the bottom of the suction nozzle 15 is provided with a concave sealing groove 16, and a sealing ring 17 is arranged in the sealing groove 16, so as to improve the sealing performance between the diversion pipe 14 and the suction nozzle 15 and prevent the liquid in the container from overflowing from the gap between the diversion pipe 14 and the suction nozzle 15 when passing through the diversion pipe 14.

The lower end of the diversion pipe 14 is provided with a limiting step 18, which is arranged at the bottom of the cavity 4, and the driving casing 7 and the suction nozzle 15 are arranged on the limiting step 18 to increase the stability of the water drinking component 2 and prevent it from toppling after long-term use. The limiting step 18 is provided with a plurality of annularly distributed notches 19, and the bottom of the driving casing 7 is provided with clamping blocks 20 matching the notches 19. When the driving casing 7 is assembled with the water drinking component 2, the clamping blocks 20 are buckled into the notches 19, and when the driving casing 7 rotates, the clamping blocks 20 can also drive the diversion pipe 14 to rotate, facilitating the rotation and lifting of the water drinking component 2.

The assembly groove 21 extends downwards from the bottom of the cavity, the tail end of the diversion pipe 12 penetrates through the driving casing 7 and the cavity 4 and is buckled into and rotatably installed in the assembly groove 21. The bottom of the diversion pipe 14 is provided with a downward extending sealing element 22, and the bottom of the assembly groove 21 is provided with an opening 23. The sealing element 22 passes through the opening 23 and is rotatably clamped in the opening 23 to form a seal, so as to prevent the liquid in the container from entering the assembly groove 21 through the opening 23.

The sealing element 22 is provided with an incision 42. Press the two sides of the sealing element 22 to close the notch 42, and then the sealing element 22 is reduced in diameter, and the clamping state with the opening 23 is released. After the rotating cover 6 is removed, the water drinking component 2 can be pulled up and taken out for cleaning. The sealing 22 can be repositioned to the incision 42 due to its own soft rubber material.

The sealing element 22 is provided with a rib ring 24 engaged with the opening 23, which further improves the sealing performance between the sealing element 22 and the opening 23. The rib ring 24 is provided with an inclined guide surface 25. When the sealing element 22 passes through the opening 23, the inner wall of the opening 23 moves along the guide surface 25 for easier assembly. After assembly, the top surface of the rib ring 24 is attached to the bottom of the opening 23 to form a good seal.

One side of the assembly groove 21 is provided with an openable first water inlet 26, and the side wall of the diversion pipe 14 is provided with a second water inlet 27. When the water drinking component 2 rotates to open, the suction nozzle 14 rises and protrudes above the rotating cover 6, and the diversion pipe 14 rotates until the second water inlet 27 is aligned with the first water inlet 26. The liquid in the container flows into the diversion pipe 14 through the first water inlet 26 and the second water inlet 27, and is finally discharged from the suction nozzle 15 for drinking. When the water drinking component 2 is closed by rotation, the suction nozzle 15 descends into the driving casing 7, and the diversion pipe 14 rotates and closes the first water inlet 26, so as to prevent the liquid in the container from entering the first water inlet 26.

A sealing ring 28 is arranged between the assembly groove 21 and the diversion pipe 14, and is sleeved on the diversion pipe 14. The top of the sealing ring 28 is placed at the lower end of the limiting step 18. The sealing ring 28 is for enhancing the sealing performance of the first water inlet 26 and further improving the sealing of the opening 23. If the liquid in the container accidentally passes through the sealing gap between the sealing member 22 and the opening 23, the sealing ring 28 plays the back-up sealing role. The sealing ring 28 is provided with a hole 29 corresponding to the second water inlet 27. When the sealing ring 28 is sleeved on the diversion pipe 14, the hole 29 matches the second water inlet, and the sealing ring 28 rotates synchronously with the diversion pipe 14. When the drinking component 2 is opened, the hole 29 rotates until it is aligned with the first water inlet 26, and the liquid in the container sequentially enters the diversion pipe 14 through the first water inlet 26, the hole 29 and the second water inlet 27, and is finally discharged from the suction nozzle 15. When the drinking component 2 is closed, the sealing ring 28 blocks the first water inlet 26.

The sealing ring 28 is provided with a first sealing rib 30 and a second sealing rib 31, which are placed at the upper and lower ends of the first water inlet 26 respectively, further enhancing the sealing effect between the sealing ring 28 and the first water inlet 26.

A hollow connecting column 32 is arranged on the outer side of the assembly groove 21 at the bottom of the cavity 4, a suction pipe adapter 33 is threaded on the connecting column 32, and a suction pipe is fit on the suction pipe adapter 33. The side wall of the suction pipe adapter 33 is provided with a toggle piece 34. Turn the toggle piece 34 to disassemble the suction pipe adapter for cleaning.

The rotating cover 6 is arranged with a sliding cover 35 for movably opening the water drinking component 2 and a sliding cover mounting groove 36. The sliding cover 35 is slidably installed in the sliding cover mounting groove 36. The sliding cover 35 rotates with the rotating cover 6. When drinking, slide the sliding cover 35 to one side to expose the through hole 9, and the suction nozzle 15 passes through the through hole 9 and rises above the rotating cover 6. After drinking, rotate to lower the suction nozzle 15, and then slide the sliding cover 35 to cover the through hole 9 to prevent the liquid inside from overflowing and the external dust from entering. The two ends of the slide cover 35 are respectively provided with a first pushing part 37 and a second pushing part 38, which are inclined planes with different directions. Press on the first pushing part 37 or the second pushing part 38 to push the slide cover 35 to slide outward or inward.

The sliding cover mounting groove 36 is provided with a lower magnetic piece a40 and a lower magnetic piece b41, which are on the same horizontal direction; the bottom of the slide cover 35 is provided with an upper magnetic piece 39. When the slide cover 35 is closed, the upper magnetic piece 39 and the lower magnetic piece a40 attract each other to close the through hole 9, and the slide cover 35 is limited and closed by magnetic attraction. Manually slide the slide cover 35 to one side, and the upper magnetic piece 39 and the lower magnetic piece a40 that are attracted to each other are separated until the upper magnetic piece 39 is attracted to the lower magnetic piece b41 for limiting the slide cover 35 opened, and at this time, the through hole 9 is in an open state.

For those skilled in the art, it is obvious that the present invention is not limited to the details of the above exemplary embodiments, and can be embodied in other specific forms without departing from the spirit or essential attributes thereof. Accordingly, the embodiments should be considered as exemplary and non-limiting in all aspects, and the scope of the invention is defined by the appended claims rather than the above specifications, so it is intended to embrace all changes within the meaning and range of equivalents of the claims, and no reference numeral parts in the claims should be regarded as limiting the claims involved.

We claim:

1. A lid with a drinking assembly configured to be movably opened and closed, comprising:

a cover;

the drinking assembly arranged on the cover;

an air return valve is arranged on the cover; wherein the cover is defined with a cavity configured to accommodate movement of the drinking assembly; and a driving element is arranged in the cavity, wherein the drinking assembly is mounted within the driving element, and the driving element is configured to drive the drinking assembly to move;

wherein the drinking assembly is operable between an open mode and a closed mode, in which:

in the open mode, the driving element is actuated to drive the drinking assembly upwardly, such that the drinking assembly protrudes above the cover;

in the closed mode, the driving element is actuated to drive the drinking assembly downwardly, such that the drinking assembly is concealed within the cavity;

wherein the driving element comprises a rotating cover and a cylindrical driving housing, the cover is provided with a mounting groove for mounting the rotating cover; wherein a clamping part is arranged between the rotating cover and the cylindrical driving housing, such that the rotating cover drives the cylindrical driving housing to rotate synchronously;

wherein the drinking assembly is mounted in the cylindrical driving housing, a through hole is defined in the rotating cover for the drinking assembly to pass through, and a movable part is arranged between the cavity and the drinking assembly, such that rotation of the driving element.

2. The lid with the drinking assembly according to claim 1, wherein the movable part comprises:

a movable groove arranged on an inner wall of the cavity and extending upward in an arc shape;

a guide groove defined on a side wall of the cylindrical driving housing; and a movable block extending through the guide groove from both sides of the drinking assembly, wherein the movable block is buckled into the movable groove, and when the driving element rotates, the movable block moves along the movable groove, thereby driving the the movement of the drinking assembly.

3. The lid with the drinking assembly according to claim 1, wherein the drinking assembly comprises a diversion pipe and a suction nozzle sleeved on the diversion pipe, wherein an inner wall at a bottom of the suction nozzle is provided with a sealing groove; a lower end of the diversion pipe is provided with a limiting flange extending outward, which is placed at a bottom of the cavity, and the cylindrical driving housing is arranged on the limiting flange.

4. The lid with the drinking assembly according to claim 3, wherein the bottom of the cavity is defined with an assembly groove, a tail end of the diversion pipe penetrates through the cylindrical driving housing and the cavity and is buckled into the assembly groove, and a bottom of the diversion pipe is provided with a sealing element, which passes through an opening on a bottom of the assembly groove and is clamped at the opening to form a seal.

5. The lid with the drinking assembly according to claim 4, wherein the sealing element is provided with a rib ring clamped at the opening, and the rib ring is provided with a guide surface.

6. The lid with the drinking assembly according to claim 4, wherein one side of the assembly groove is provided with a first water inlet, and a side wall of the diversion pipe is provided with a second water inlet; when the drinking assembly rotates, the suction nozzle rises and protrudes above the rotating cover, and the diversion pipe rotates until the second water inlet is aligned with the first water inlet.

7. The lid with the drinking assembly according to claim 6, wherein a sealing ring is arranged between the assembly groove and the diversion pipe, and is sleeved on the diversion pipe, a notch corresponding to the second water inlet is formed on the sealing ring, and the sealing ring rotates synchronously with the diversion pipe; the sealing ring is provided with a first sealing rib and a second sealing rib, which are located at upper and lower ends of the first water inlet, respectively.

8. The lid with the drinking assembly according to claim 4, wherein a hollow connecting column is arranged on an outer side of the assembly groove at the bottom of the cavity, and a detachable suction pipe adapter is mounted on the connecting column, and a toggle piece is arranged on a side wall of the suction pipe adapter.

9. The lid with the drinking assembly according to claim 1, wherein the rotating cover is provided with a sliding cover configured to open or close the drinking assembly, a sliding cover mounting groove is arranged on the rotating cover, and the sliding cover is movably mounted in the mounting groove; the sliding cover has a first pushing part and a second pushing part at its two ends.

* * * * *